US006669840B2

(12) United States Patent
Burrow

(10) Patent No.: US 6,669,840 B2
(45) Date of Patent: Dec. 30, 2003

(54) FILTER FOR A CARPET CLEANING SYSTEM

(76) Inventor: David O. Burrow, 20 Jody La., Camarillo, CA (US) 93010

( * ) Notice: Subject to any disclaimer, the term of this patent is extended or adjusted under 35 U.S.C. 154(b) by 0 days.

(21) Appl. No.: 10/093,875

(22) Filed: Mar. 7, 2002

(65) Prior Publication Data

US 2002/0084212 A1 Jul. 4, 2002

Related U.S. Application Data

(62) Division of application No. 09/836,985, filed on Apr. 17, 2001, now Pat. No. 6,391,208

(60) Provisional application No. 60/198,280, filed on Apr. 17, 2000.

(51) Int. Cl.[7] ..... B01D 35/14; F04F 10/00

(52) U.S. Cl. ..... 210/104; 210/416.1; 15/353; 137/124; 137/142

(58) Field of Search ..... 210/97, 109, 104, 210/137, 241, 295, 320, 416.1, 513, 521, 522, 744, 767, 800, 804, 314, 318; 137/123, 140, 142, 152, 124; 15/321, 353

(56) References Cited

U.S. PATENT DOCUMENTS 1,163,058 A * 12/1915 Belfranci
1,579,158 A * 3/1926 Smilie
4,126,556 A * 11/1978 Swanson et al.
4,992,165 A * 2/1991 Jensen
5,705,054 A * 1/1998 Hrysky
6,077,448 A * 6/2000 Tran-Quoc-Nam et al. . 210/521

* cited by examiner

*Primary Examiner*—Joseph Drodge
(74) *Attorney, Agent, or Firm*—Kenneth J. Hovet

(57) ABSTRACT

A filter for a carpet cleaning device and method for using therefor includes a casing and a partition that extends into the casing to define a primary chamber and a secondary chamber within the casing. A main siphon with an inverted U-shape is mounted in the partition. One end of the siphon extends into the primary chamber while the other end of the siphon extends into the secondary chamber. An auxiliary siphon is located within the secondary chamber, and a pump is attached in fluid communication with the auxiliary siphon. During operation, a wastewater/debris stream is transported into the filter. The stream collects in the primary chamber and establishes a primary fluid level therein. As the primary fluid level rises, carpet fibers and other insoluble debris settle in the primary chamber. Once the primary fluid level is even with the siphon, wastewater fluid is transported from the primary chamber to the secondary chamber and establishes a secondary fluid level therein. As the secondary fluid level rises, any remaining debris settles in the secondary level. Once the secondary fluid level reaches a predetermined level, the pump is activated to transport wastewater from the secondary chamber for further disposal.

9 Claims, 4 Drawing Sheets

FILTER FOR A CARPET CLEANING SYSTEM

This Divisional Application claims priority from application Ser. No. 09/836,985, which was filed Apr. 17, 2001, now U.S Pat. No. 6,391,208 and claims benefit of Provisional Application No. 60/198,280, filed on Apr. 17, 2000.

FIELD OF THE INVENTION

The present invention pertains generally to filters. More particularly, the present invention pertains to filters for carpet cleaning devices. The present invention is particularly, but not exclusively, useful as a filter which continually removes synthetic fibers and other insoluble debris from a wastewater stream which is generated by operation of the carpet cleaning device.

BACKGROUND OF THE INVENTION

Carpet cleaning devices are known in the prior art. Certain types of these devices use water as the primary agent for cleaning a carpet. For water-based devices, the carpet cleaning process generates a wastewater stream which must be properly disposed of once the process is completed.

Various local, state and federal agencies, as well as industry organizations, have developed guidelines for proper on-site disposal of wastewater from a carpet cleaning process. For example, disposal of wastewater within a sanitary sewer system at the site is allowed under certain conditions. Alternatively, on-site land wastewater disposal is allowed under certain conditions if permission is obtained from the property owner. But no matter which manner of on-site disposal is required, an initial pre-filtering step is almost always required to remove synthetic carpet fibers and other insoluble debris from the wastewater stream.

Carpet cleaning devices are typically mounted in mobile units, such as trucks or vans. For these mobile units, space is a consideration, and the devices should be small and take up as little space as possible. Thus, many of these devices do not include the additional equipment for continuously removing the synthetic fibers and debris during operation, which would allow for on-site disposal of the wastewater. Instead, in order to comply with federal/state/industry guidelines, most vehicles have a large holding tank for holding the wastewater stream for further transportation back to their place of business. Unfortunately, such a configuration is unwieldy and inefficient. Time and money is lost because the mobile unit must return to the business location in order to dispose of the wastewater in the holding tank before moving on to the next cleaning job, unless the mobile unit illegally dumps the wastewater into a nearby storm drain to save time. Further, the holding tank takes up valuable cargo space in the mobile unit.

U.S. Pat. No. 5,430,910, which issued to Wiley for an invention entitled "Carpet Cleaning Apparatus", discloses a separation vessel with a first and second annular space for removing air from a wastewater stream. Wiley discloses a sealed outer shell, an air tube coaxially installed in the shell, and a liquid tube installed around the air tube in a spaced apart relationship. This forms a first and second annular space within the shell.

In Wiley, however, the lower portions of the respective first and second annular spaces are in fluid communication with each other. This is not an effective arrangement for allowing insoluble debris to settle at the bottom of the tank. Additionally, Wiley's shell is sealed and does not provide for access. This is because Wiley does not remove debris from the wastewater. His device is merely designed for removing air from the wastewater stream.

U.S. patent application Ser. No. 5,430,910, which issued to Sprinkle for an invention entitled "Self-Contained, Closed-Loop, Hard Surface and Carpet Cleaning Apparatus", discloses a gravity separation unit with a housing having an interior wall that establishes two separate chambers within the housing. Sprinkle, however, does not disclose a U-shaped siphon which establishes fluid communication between the two chambers, nor does Sprinkle disclose an angled connection for taking a secondary suction from one of the chambers.

In view of the above, it is an object of the present invention to provide a filter for a carpet cleaning device which is portable and which can be mounted in a mobile unit. It is another object of the present invention to provide a filter for a carpet cleaning device which continually removes synthetic fibers and non-biodegradable debris from a generated wastewater stream of a carpet cleaning device, while the device is in operation. Another object of the present invention is to provide a filter for a carpet cleaning device which obviates the need for a holding tank for holding wastewater which includes fibers and insoluble debris. It is another object of the present invention to provide a filter for a carpet cleaning device which is relatively simple to use, is relatively easy to manufacture and is comparatively cost effective.

SUMMARY OF THE INVENTION

A filter for a carpet cleaning device in accordance with the present invention includes a casing and a partition which extends upwardly from the casing floor to define a primary chamber and a secondary chamber in the casing. As a wastewater/debris stream is transported into the filter, the stream is initially contained in the primary chamber. As the stream collects in the primary chamber, the debris settles at the bottom of the primary chamber and a primary fluid level of wastewater is further established therein.

A main siphon having an inverted U-shape is mounted in the partition to establish a path of fluid communication between the primary chamber and the secondary chamber. The main siphon has a horizontal section which merges into two opposing vertical portions that extend downwardly from the horizontal section into a respective primary chamber and secondary chamber.

The secondary chamber further includes an auxiliary siphon which is located in the secondary chamber. The auxiliary siphon comprises an auxiliary horizontal portion that is attached to the casing and a downturned auxiliary vertical portion which projects from the auxiliary horizontal portion in an angled configuration. The auxiliary horizontal portion is further connected to a pump.

The filter of the present invention also includes a filter basket which is removably placed within the filter and which rests on the partition edge when placed therein. The filter basket is manufactured with a primary compartment and a secondary compartment. When in place, the primary compartment of the basket is sized to correspond with the primary chamber, and the secondary compartment is sized to correspond with the secondary chamber when the basket is placed in the filter. The filter basket is located within the filter so that any wastewater/debris stream that is transported into the filter passes through the basket before entering the primary chamber. Thus, the filter basket functions to eliminate any larger chunks of debris from the wastewater stream before the stream enters the primary chamber. Once full, the filter basket is removed, and the debris is disposed of.

For the method of the present invention, a wastewater/debris stream from a carpet cleaning device is transported into a filter having the above-summarized structure. After larger pieces of debris are removed by the basket filter, the wastewater/debris stream enters the primary chamber, where it collect to establish a primary fluid level. As the primary fluid level rises, most of the debris settles at the bottom of the primary chamber.

When the above-mentioned primary fluid level becomes about even with the horizontal portion, a Venturi effect is created in the siphon (in accordance with known scientific principles) which causes wastewater to be transported through the main siphon from the primary chamber to the secondary chamber. As the wastewater enters the secondary chamber, it collects to establish a secondary fluid level therein. As the secondary fluid level rises, any remaining debris settles at the bottom of the secondary chamber. When the secondary fluid level reaches a predetermined level, the pump is selectively activated to remove wastewater (without debris) from the filter for further disposal.

With the filter and method of the present invention, "processed" wastewater (wastewater without debris) can be continually removed from the filter while simultaneously introducing a wastewater/debris stream into the filter. Stated differently, the filter and method of the present invention allow for sufficient processing of the wastewater so that the wastewater can be disposed of on-site, while the carpet cleaning device (which generates the wastewater/debris stream) is operating. This allows for increased efficiency and flexibility in the operation of mobile-mounted carpet cleaning devices in remote locations.

BRIEF DESCRIPTION OF THE DRAWINGS

The novel features of this invention will be best understood from the accompanying drawings, taken in conjunction with the accompanying description, in which similar characters refer to similar parts, and in which.

WRITTEN DESCRIPTION OF THE PREFERRED EMBODIMENT

Figure 1:
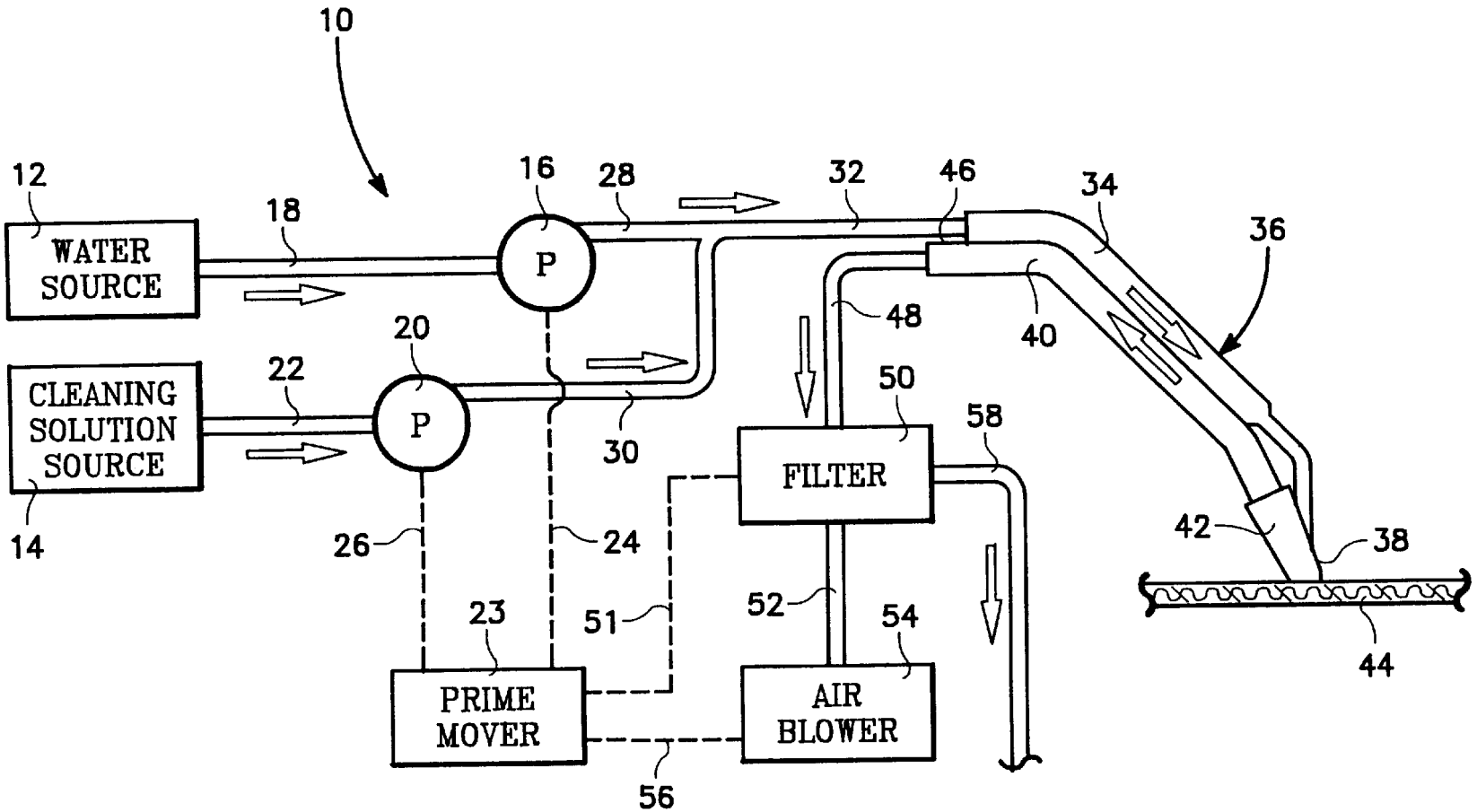
FIG. 1 is a schematic diagram of a generic carpet cleaning system that uses the filter of the present invention.

In overview, and referring initially to FIG. 1, a schematic diagram for a carpet cleaning system that uses the filter of the present invention is shown and is generally designated by reference character 10. The system includes a water source 12 and a cleaning solution source 14. A water pump 16 is connected in fluid communication with the water source via water inlet line 18. Similarly, a solution pump 20 is connected in fluid communication with the cleaning solution source via solution inlet line 22. The water pump and solution pump are driven by a prime mover 23, as indicated by dashed lines 24 and 26, respectively. The prime mover is preferably an internal combustion engine that is mounted on a vehicle (not shown).

A water outlet line 28 is connected in fluid communication with the outlet of the water pump 16, and a solution outlet line 30 is similarly connected to the outlet of the solution pump 20. The respective water and solution output lines merge into a working fluid line 32. The working fluid line is connected in fluid communication with a receiving conduit 34 of a cleaning wand 36.

At the free end 38 of the wand, the receiving conduit and a wastewater conduit 40 are connected to a cleaning attachment 42. The cleaning attachment engages a carpet 44 for cleaning in a manner known in the prior art. At the proximal end 46 of the wand, the wastewater conduit merges into a wastewater line 48, which is connected in fluid communication with the filter 50 of the present invention.

As shown in FIG. 1, a vacuum line 52 interconnects the filter with an air blower 54. The air blower is powered by the same prime mover discussed above, as indicated by line 56. Vacuum line 52 for the carpet system is in fluid communication with the filter via a fixed vacuum connection 110 that is located on the top portion of the casing (See FIG. 2). With this configuration, operation of the air blower establishes a vacuum in the filter. A filtered wastewater line 58 is also connected in fluid communication with the filter, as more fully discussed below. The filtered wastewater line discharges filtered wastewater to various locations, as also discussed below.

Figure 2:
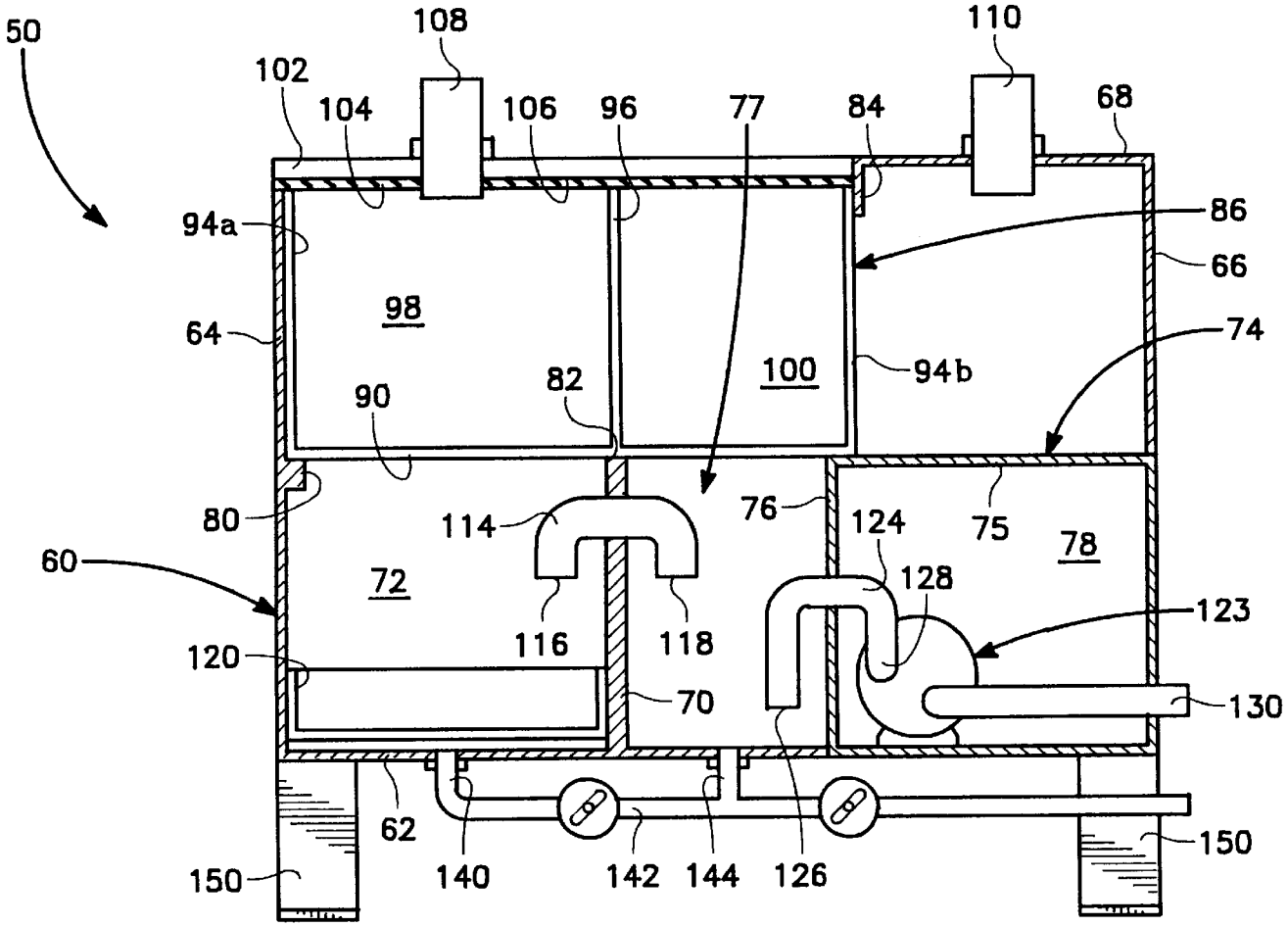
FIG. 2 is a cross-sectional view of the filter depicted in FIG. 1.
Figure 3:
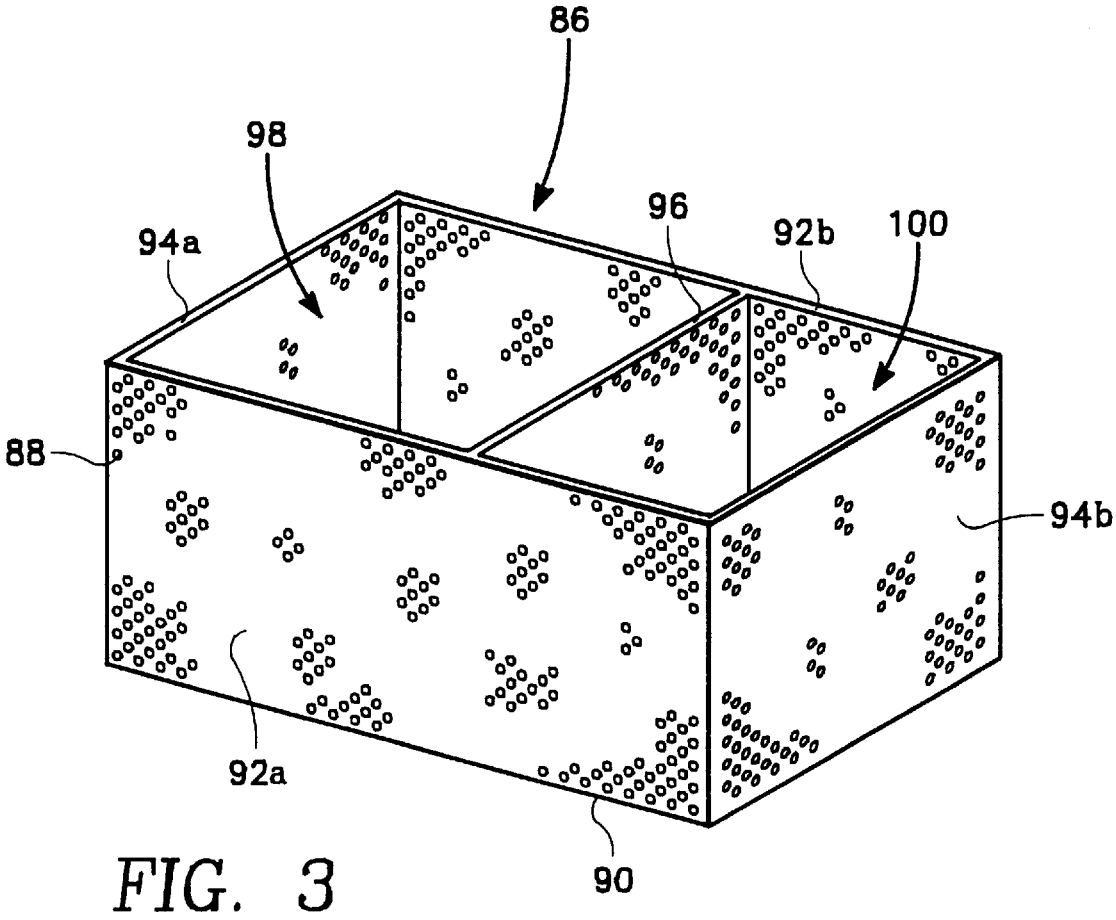
FIG. 3 is an isometric view of the basket for the filter of FIG. 2
Figure 4:
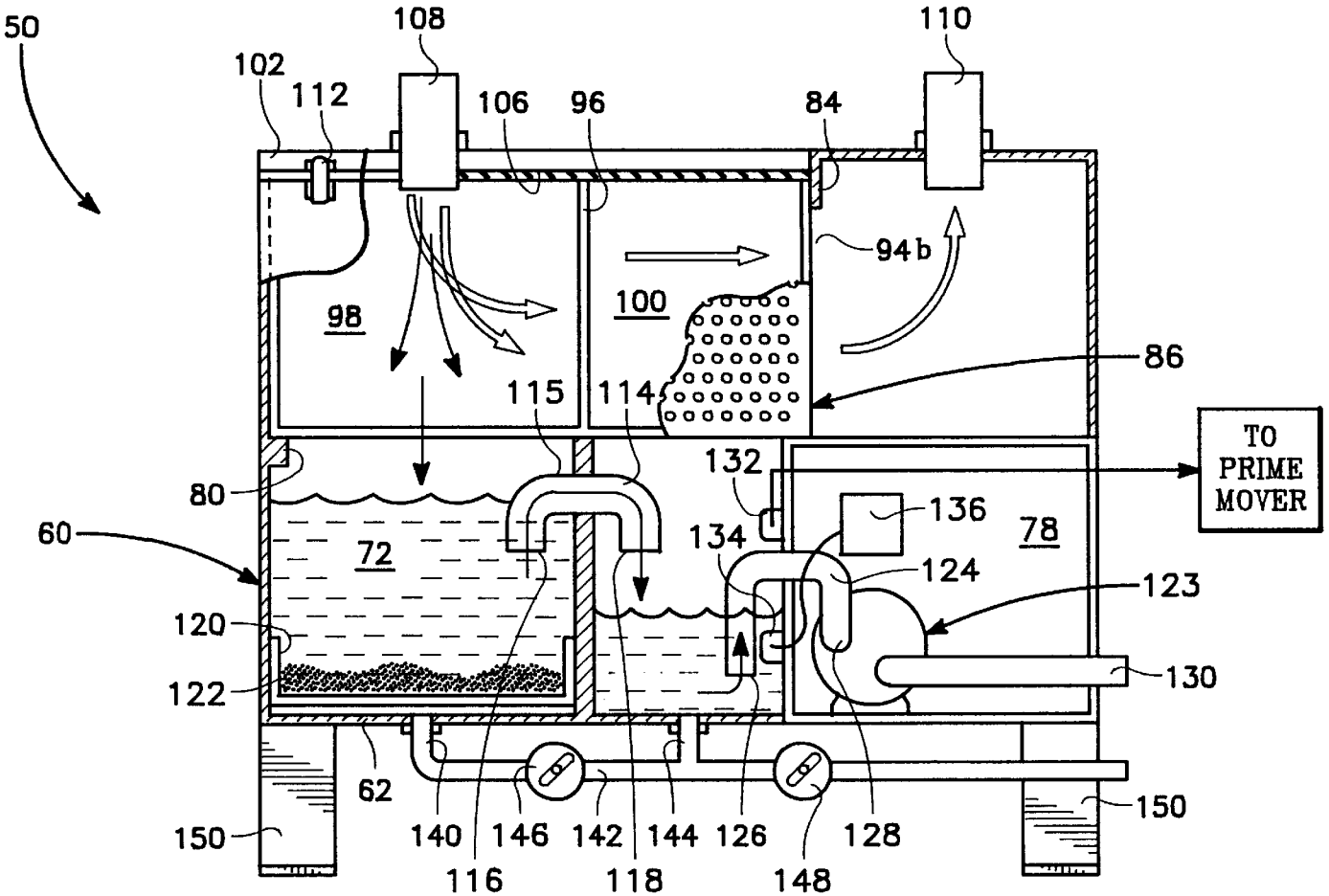
FIG. 4 is cross-sectional view of the filter of FIG. 2 which shows the flow path of the fluids therethrough during operation, with portions broken away for clarity.

With reference now to FIGS. 2–4, the carpet cleaning filter of the present invention is illustrated in greater detail. As shown, the filter includes a casing 60 having a bottom 62, casing sides, 64, 66 and a casing top portion 68. The casing is formed with a main partition 70 that extends upwardly from the bottom into the casing interior. The main partition, in combination with casing side 64 and the casing bottom, define a primary chamber 72 with an open top.

The filter further includes a pump partition 74 with a horizontal section 75 and a vertical section 76. The vertical section of the pump partition, in combination with the main partition and casing bottom, define a secondary chamber 77 for the filter which, like the primary chamber, has an open top. The horizontal and vertical sections of the pump partition also cooperate with the casing bottom and casing side 66 to define a pump enclosure 78.

Casing side 64 is formed with an inner ledge 80 that extends coextensively with the top edge 82 of main partition 70 and with the surface of horizontal section 75. The top wall 68 inner edge of the casing is provided with a downturned abutment flange 84. The casing structure is configured in this manner to incorporate a lint basket 86 into the filter, for reasons to be discussed.

Referring primarily to FIG. 3, the lint basket 86 is defined by interconnected basket walls formed with a plurality of openings 88. The openings are sized so that large debris which is typically picked up by a cleaning wand will not pass, but smaller debris such as sand, for example, will pass therethrough.

The lint basket includes a bottom wall 90 and longitudinal side walls 92*a*, 92*b* and end walls 94*a*, 94*b* that extend substantially perpendicularly from bottom wall 90 in a rectangular configuration. A basket partition 96 extends from the basket bottom wall and from longitudinal side wall 92*a* to longitudinal side wall 92*b*. The above structures define a primary compartment 98 and a secondary compartment 100 for the basket. The basket partition is slightly offset from the midpoint of the longitudinal side walls so that the primary compartment is larger than the secondary compartment.

As best seen in FIGS. 2 and 4, the lint basket is placed in the casing so that the basket bottom wall 90 rests upon the casing ledge 80, the top edge 82 of the main partition 70, and horizontal section 75 of the pump enclosure. The placement of the basket in the casing in this manner also places end wall 94*a* flat against casing side 64 and engages opposing side wall 94*b* against abutment flange 84 in the top portion of the casing. Because basket partition 96 is offset from the midpoint of the longitudinal side walls as mentioned above, the basket partition 96 is oriented directly above the main partition 70 in the casing when the basket is placed in the filter as shown in the Figures. Finally, placement of the lint basket against the casing in this manner encloses the open tops of both the primary chamber and the secondary chamber. With this configuration, primary compartment 98 is directly over primary chamber 72 and secondary compartment is directly above secondary chamber 77 when the basket is placed within the filter as described above.

Above the basket 86, the filter of the present invention further includes a removable lid 102. The lid is formed with a gasket 104 on its underside 106 for providing an airtight seal when the lid is attached to the filter. A wastewater connection 108 is mounted in the lid. The wastewater connection is connected in fluid communication with the wastewater line 48 (See FIG. 1), for receiving wastewater from the carpet cleaning device. The wastewater connection is further located directly over the primary compartment of the lint basket. A plurality of quick release latches 112, as best seen in FIG. 4, are used to attach the lid to the filter. This allows quick and convenient access to the basket for cleaning after operation of the filter as described below.

Within the casing, a tube-like main siphon 114 places the primary chamber in fluid communication with the secondary chamber. The main siphon has an inverted U-shape and a horizontal portion 115 that is secured to the main partition. At one end of the horizontal portion is a downturned inlet end 116 that extends into the primary chamber. At the horizontal portion opposing end is a downturned outlet end 118 that extends into the secondary chamber. At the bottom of the primary chamber, a lift-out tray 120 is included for cleaning the filter and to facilitate removal of any insoluble debris 122 that may collect in the primary chamber, as shown in FIG. 4.

A filtered wastewater pump 123 is mounted to the casing bottom within the pump enclosure, as shown in FIGS. 2 and 4. The filtered wastewater pump is powered by the prime mover discussed above and is connected in fluid communication with the secondary chamber via an auxiliary siphon 124. In similar fashion to the main siphon, the auxiliary siphon is formed in an inverted U-shape. The auxiliary siphon is secured to the pump partition so that its intake end 126 is positioned in the secondary chamber and its discharge end 128 is connected in fluid communication with the filtered wastewater pump. The pump outlet is connected in fluid communication with filtered wastewater outlet tubing 130 which passes through casing side 66, as shown in FIGS. 2 and 4. The outlet pump tubing merges into filtered wastewater line 58 (See FIG. 1).

A high level switch 132 and a low level switch 134 are located in the secondary chamber and are mounted to the vertical section 76 of the pump partition, as shown in FIG. 4. The high level switch is electrically connected to the prime mover, as indicated by shutdown line 51 in FIG. 1. The low level switch is wired to a controller 136 which is located within the pump enclosure. The prime mover and controller, in response to signals from the high and low level switches, respectively, operate as described below.

A primary cleaning fitment 140 is mounted in the casing bottom, to place the primary chamber in fluid communication with blowdown piping 142. Similarly, a secondary cleaning fitment 144 is mounted to the casing bottom and places the secondary chamber in fluid communication with the blowdown piping. Valves 146 and 148, which are normally closed during operation, are further included in the blowdown piping. The blowdown piping and valves facilitate filter cleaning when it is not in operation by providing a flow path for flushing the primary and secondary chambers. Finally, a plurality of mounting brackets 150 are mounted to the underside of the casing bottom, to allow for mounting the filter to a mobile unit (not shown), such as a van or truck.

OPERATION

To start the system, the prime mover is actuated to begin operation of the water and solution pumps. The water pump transports water from the water source to the working fluid line, while the solution pump transports cleaning solution from the solution source to the working fluid line. In the working fluid line, the water and cleaning solution mix and yield an effective carpet cleaning fluid which flows into the receiving conduit of the cleaning wand. Simultaneously, the prime mover operates the air blower 54, which creates a vacuum in the filter which, in turn, creates a vacuum at the wand free end 38 via wastewater line 48 and wastewater conduit 40 of the cleaning wand.

As the cleaning fluid flows through the cleaning attachment 42, it will be directed into the carpet fibers for engagement with dirt, lint and other insoluble debris. In sequence, the vacuum at free end 32 will draw the cleaning fluid, air and entrained materials from the carpet into the wastewater conduit 40 for discharge into filter 50 via wastewater line 48 and connector 108.

As the air/wastewater combination is drawn into the filter, the lighter air passes through the openings 88 in basket partition 96 and end wall 94*b* of the filter basket, and out of the filter through vacuum connection 110. Any large fibers/lint in the outgoing airflow are trapped by the basket partition 96 and end wall 94*b*. The heavier wastewater passes through the basket bottom wall 90 and enters the primary chamber 72. As wastewater collects in the primary chamber, the fluid level therein begins to rise. While this is happening, carpet fibers and insoluble debris separate from the wastewater and settle in the liftout tray 120 at the bottom of the primary chamber.

When the water level in the primary chamber reaches the horizontal portion of the main siphon, a siphoning action of wastewater from the primary chamber to the secondary chamber occurs in accordance with known scientific principles. The main siphon continues to transport wastewater from the primary chamber to the secondary chamber until the wastewater level in the primary chamber drops below the level of the inlet end of the main siphon. At this point, the transporting action stops and the wastewater level in the primary chamber will again begin to rise.

As the wastewater is transported from the primary chamber to the secondary chamber, wastewater collects in the secondary chamber, and the fluid level therein begins to rise. While this is happening, any remaining insoluble debris in the wastewater in the secondary chamber separates and settles at the bottom of the secondary chamber.

Once the wastewater in the secondary chamber reaches a predetermined level that is above the low level switch 134, the switch will send a signal to the controller 136. In response, the controller activates filtered wastewater pump 123, and pump 123 transports the filtered wastewater from the secondary chamber through the filtered wastewater tubing 130 and into the filtered wastewater line 58 for further disposal.

As wastewater is transported from the secondary to the filtered wastewater line for disposal, the wastewater level in the secondary chamber decreases until it is about even with the low level float switch 134. Once the wastewater level in the secondary chamber drops below this level, the low level float switch will send a signal to the controller 136 to deactivate the filtered wastewater pump. Once the pump is deactivated, the wastewater level in the secondary chamber will remain the same until more wastewater is siphoned from the primary chamber to the secondary chamber. When this occurs, the wastewater level in the secondary chamber begins to rise until the low level switch reactivates the pump, and the cycle is repeated.

During normal operation, the wastewater level in the secondary chamber should never reach a level that is about even with the high level switch 132. Should the wastewater level in the secondary chamber ever reach this level, however, the high level switch sends a signal to the prime mover 23 via shutdown line 51. The primer mover, in response to this signal, stops, which further stops the entire carpet cleaning system. This prevents any further transfer of wastewater into the secondary chamber (which prevents any further increase in wastewater level therein) and stops the air blower, in order to prevent wastewater from entering an energized air blower and causing extensive damage to the blower.

The shape of the main siphon is important. Specifically, the inverted U-shape is required to locate the inlet end of the main siphon at about the midpoint of the wastewater level in the primary chamber when the siphoning action of wastewater between the primary and secondary chambers occurs. This maintains a sufficient distance between the main siphon inlet and the debris that has settled at the bottom of the primary chamber so that the settled debris is not carried into the secondary chamber during the siphoning action.

Similarly, the inlet of the auxiliary siphon 124 is located at approximately the midpoint between the low level float switch and the casing bottom. With this configuration, the auxiliary pump intake will be at about the midpoint of the wastewater level in the secondary chamber when the wastewater is at it lowest level, about even with the low level switch. With the intake positioned in this manner, any insoluble debris that may have settled at the bottom of the secondary chamber is not transported out of the filter through the filtered wastewater pump.

While the particular filter for a water carpet cleaning system, as herein shown and disclosed in detail, is fully capable of obtaining the objects and providing the advantages above stated, it is to be understood that the presently preferred embodiment is merely illustrative of the invention. As such, no limitations are intended other than as defined in any future appended claims.

What is claimed is:

1. A filter for a carpet cleaning device comprising:

a casing;

a partition attached to said casing to extend therefrom, said partition defining a primary chamber and a secondary chamber in said casing;

a main siphon mounted in said partition and placing said primary chamber in fluid communication with said secondary chamber;

an auxiliary siphon having a vertical auxiliary portion and a horizontal auxiliary portion attached to said casing, said vertical auxiliary portion being oriented substantially perpendicular to said horizontal auxiliary portion and being in fluid communication with said secondary chamber;

a pump connected to said casing in fluid communication with said auxiliary siphon;

a prime mover connected to said pump for powering said pump;

a high level switch electrically connected to said prime mover for selectively stopping said prime mover; and, a low level switch electrically connected to said pump for selective operation of said pump.

2. The filter of claim 1 wherein said main siphon has an inverted U-shape, and further wherein said main siphon has a first end extending into said primary chamber and a second end extending into said secondary chamber.

3. The filter of claim 2 wherein said main siphon has a horizontal portion and a first vertical portion oriented substantially perpendicular to said horizontal portion and terminating at said first end, and a second vertical portion oriented substantially perpendicular to said horizontal portion and terminating at said second end.

4. The filter of claim 3 wherein said primary chamber has a primary fluid level when wastewater is transported into said filter, and further wherein said main siphon transports said wastewater from said primary chamber to said secondary chamber when said primary fluid level is about even with said horizontal portion.

5. The filter of claim 1 wherein said high level switch is mounted to said casing within said secondary chamber and above said horizontal auxiliary portion, and further wherein said low level switch is mounted to said casing within said secondary chamber and below said horizontal auxiliary portion.

6. The filter of claim 1 further comprising:

a filter basket removably placed within said filter and formed with a primary compartment and a secondary compartment, said primary compartment corresponding to said primary chamber and said secondary compartment corresponding to said secondary chamber when said basket is placed in said filter.

7. A filter for a carpet cleaning device comprising:

a first casing defining a primary chamber;

a second casing defining a secondary chamber and attached in fluid communication with said first casing;

an angled connection attached to said secondary casing to extend therefrom into said secondary chamber, said angled connection having a horizontal portion and a downtrend vertical portion oriented about perpendicular to said horizontal portion;

a pump for transporting wastewater attached in fluid communication with said angled connection;

a tube having an inverted U-shape with a tube horizontal portion and a pair of respective downturned tube vertical portions protecting from said tube horizontal portion, said tube being mounted to said filter so that one of said tube vertical portions extends into said primary chamber and the other of said tube vertical portions extends into said secondary chamber;

said primary chamber having a primary fluid level when said wastewater is transported into said filter, said tube transporting said wastewater from said primary chamber to said secondary chamber when said primary fluid level is about even with said tube horizontal portion;

a prime mover connected to said pump for powering said pump;

a high level switch electrically connected to said prime mover for selectively stopping said prime mover; and, a low level switch electrically connected to said pump for selective operation of said pump.

8. The filter of claim 7 wherein said high level switch is mounted to said second casing within said secondary chamber and above said horizontal portion, and further wherein said low level switch is mounted to said casing within said secondary chamber and below said horizontal portion.

9. The filter of claim 8 further comprising:

a filter basket having a primary compartment and a secondary compartment, said primary compartment corresponding to said primary chamber and said secondary compartment corresponding to said secondary chamber when said basket is placed in said filter.

* * * * *

UNITED STATES PATENT AND TRADEMARK OFFICE

CERTIFICATE OF CORRECTION

PATENT NO. : 6,669,840 B2
DATED : December 30, 2003
INVENTOR(S) : David O. Burrows It is certified that error appears in the above-identified patent and that said Letters Patent is hereby corrected as shown below:

Title page,
Item [12], Title, delete "Burrow" insert -- Burrows --
Item [76], Inventor, delete "Burrow" insert -- Burrows --

Signed and Sealed this

Eleventh Day of May, 2004

JON W. DUDAS
*Acting Director of the United States Patent and Trademark Office*